US005405571A

United States Patent [19]

Truckner et al.

[11] Patent Number: 5,405,571

[45] Date of Patent: Apr. 11, 1995

[54] TAPE CASTING FIBER REINFORCED COMPOSITE STRUCTURES

[75] Inventors: William G. Truckner, Avonmore; Jon F. Edd, Monroeville, both of Pa.

[73] Assignee: Aluminum Company of America, Pittsburgh, Pa.

[21] Appl. No.: 148,957

[22] Filed: Nov. 8, 1993

Related U.S. Application Data

[63] Continuation-in-part of Ser. No. 899,696, Jun. 16, 1992.

[51] Int. Cl.[6] ..... B22F 7/00

[52] U.S. Cl. ..... 419/8; 419/5; 419/36; 419/48; 419/49; 419/56

[58] Field of Search ..... 419/5, 8, 36, 48, 49, 419/56; 428/548, 549, 567

[56] References Cited

U.S. PATENT DOCUMENTS 4,060,413 11/1977 Mazzei et al. ..... 419/6
4,134,759 1/1979 Yajima et al. ..... 75/204
4,259,112 3/1981 Dolowy et al. ..... 419/6
4,786,566 11/1988 Siemers ..... 428/568
4,808,076 2/1989 Jarmon ..... 416/230
4,867,644 9/1989 Wright et al. ..... 416/230
5,096,518 3/1992 Fujikawa et al. ..... 156/89
5,147,086 9/1992 Fujikawa et al. ..... 228/235.1

*Primary Examiner*—Donald P. Walsh
*Assistant Examiner*—John N. Greaves
*Attorney, Agent, or Firm*—Glenn E. Klepac

[57] ABSTRACT

A fiber reinforced composite tape is made by casting a mixture comprising high temperature metal or intermetallic particles, substantially continuous ceramic fibers and a polymeric binder. The particles are preferably titanium alloy or titanium aluminide particles having a top size of greater than about 50 microns and the binder is preferably a polyisobutylene. The cast composite tape is combined with other tapes, heated in a vacuum to remove the binder and pressed at an elevated temperature and pressure to form a composite structure suitable for high temperature applications.

20 Claims, 3 Drawing Sheets

TAPE CASTING FIBER REINFORCED COMPOSITE STRUCTURES

ORIGIN OF THE INVENTION

The invention described herein was made in the performance of a subcontract with the United States Government and may be manufactured and used for governmental purposes without the payment of any royalties therefor.

PENDING RELATED APPLICATION

This application is a continuation-in-part of copending Edd U.S. Ser. No. 899,696 filed Jun. 16, 1992 and entitled "Rotating Ring Structure for Gas Turbine Engines and Method for its Production."

FIELD OF THE INVENTION

The present invention relates to high temperature metal and intermetallic matrix composite structures for use in advanced gas turbine engines and other applications where high specific strength at elevated temperatures is desired.

BACKGROUND OF THE INVENTION

High temperature titanium alloys, titanium aluminides, nickel aluminides and molybdenum disilicide have all shown promise as composite matrix materials because of their high specific strength at elevated temperatures. However, these materials are subject to "creep" or gradual deformation at high temperatures. Accordingly, they must be reinforced with creep-resistant continuous fibers to be suitable for use at elevated temperatures.

Although the utility of the composites is known, they are difficult to manufacture and expensive. Therefore, there is still a need to provide an economical method for making composites having titanium alloy, titanium aluminide, nickel aluminide or molybdenum disilicide matrices reinforced with high strength continuous ceramic fibers.

As used herein, the term "titanium aluminide" refers to intermetallic compounds wherein titanium and aluminum are present in simple numerical ratios, including $Ti_3Al$, TiAl, $TiAl_3$ and Ti-10Al-26Nb. Some known high temperature titanium alloys are Ti-6Al-4V and Ti-6Al-2Sn-4Zr-2Mo (also known as Ti-6242). All of the alloy compositions mentioned above are described with reference to weight percentages of the alloying elements.

As used herein, the term "nickel aluminide" refers to nickel-aluminum intermetallic compounds and high temperature nickel-aluminum alloys comprising at least one half nickel. The nickel aluminides include NiAl and $Ni_3Al$.

It is a principal objective of the present invention to provide a method of forming titanium alloy, titanium aluminide, nickel aluminide and molybdenum disilicide matrix composites reinforced with ceramic fibers, utilizing cast tapes having a powdered matrix.

An additional objective of the invention is to provide a method of making fiber reinforced composite sheet materials.

Some other objectives and advantages of the invention will become apparent to persons skilled in the art from the following detailed description of our invention.

SUMMARY OF THE INVENTION

In accordance with the present invention, there is provided a film forming composition comprising a mixture of high temperature metal or intermetallic matrix particles and an organic medium. The film forming composition comprises a mixture of about 50–75 wt. % particles and about 25–50 wt. % of the organic medium. The particles preferably comprise a titanium alloy or titanium aluminide having a top or largest particle size of greater than about 50 microns. Average particle size of the preferred powder is in the range of approximately 80–120 microns.

The organic medium comprises a polymeric binder dissolved in an organic solvent. The binder may be a polycarbonate, polystyrene, acrylic, or polyisobutylene or a copolymer or mixture of such polymers. Polyisobutylene is particularly preferred. The organic solvent may be an aliphatic or aromatic hydrocarbon. Toluene is particularly preferred.

Composite matrices made with such binders must have sufficiently low impurity contents that their strength is not substantially impaired. The carbon, nitrogen, hydrogen and oxygen contents of a titanium alloy or titanium aluminide matrix made by tape casting with a polyisobutylene binder will generally be at acceptably low levels.

A monolayer fiber reinforcement for the unconsolidated tape of the invention is formed by disposing a long, substantially continuous high strength ceramic fiber adjacent an outer surface of a substrate that is coated with a film of the binder and arranged to cover a cylindrical body. A particularly preferred substrate comprises polyethylene terephthalate (PET). As used herein, the term "substantially continuous" means that the ceramic fiber may contain a few discontinuities or splices. For example, one 30,000 foot length of 5.6 mil diameter silicon carbide fiber may have approximately five splices over its entire length. The fiber is wound in a helical pattern on the coated substrate and covered with a film of the binder to form a wound fiber reinforcement.

This reinforcement is coated with powdered matrix material and binder from a slurry of the mixture described above to form the unconsolidated tape. A doctor blade controls coating thickness. The fibers may make up about 25–45% of the void-free volume of the tape. The tape has a width ranging up to several feet and length up to 10 feet or more.

Monolayer fiber reinforced unconsolidated tapes made as described above are cut or trimmed to size, separated from the substrate, stacked, encapsulated, degassed and consolidated at high temperature and pressure to make the desired unitary titanium alloy or titanium aluminide matrix article.

DETAILED DESCRIPTION OF A PREFERRED EMBODIMENT

Figure 1:
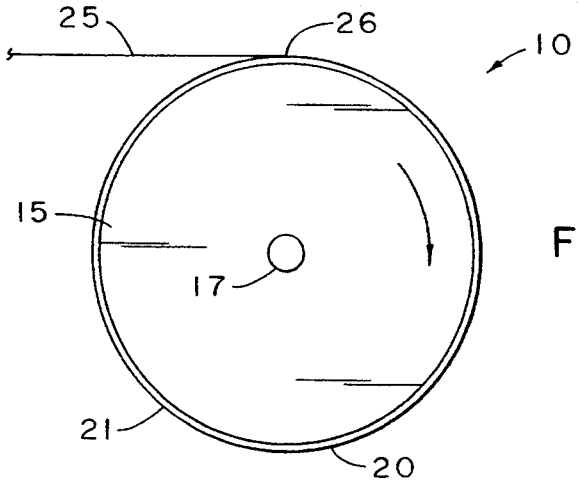
FIGS. 1 and 2 are schematic, side elevational views of an apparatus for making a fiber mat for reinforcing composite tapes in accordance with the present invention.

Referring now to FIG. 1, there is shown an apparatus 10 for production of fiber reinforcements for the composite tapes of the invention. The apparatus 10 includes a drum 15 having an axle 17 and a generally cylindrical principal surface or exterior surface 18 spaced radially outwardly from the axle 17. A polyethylene terephthalate (PET) web or substrate 20 is attached to the drum 15, extending circumferentially around the exterior surface 18.

Figure 2:
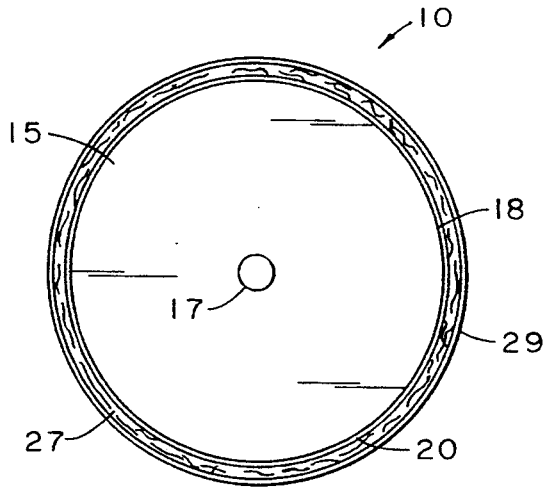

The PET web 20 is first covered with a thin film 21 of polyisobutylene dissolved in toluene. The solution of binder is made by dissolving 6.42 grams of polyisobutylene having an average molecular weight of about 75,000 in 80 grams of toluene. The film is dried to remove the toluene. Then, a substantially continuous ceramic fiber 25 is attached to the drum 15 at a first location 26 and wound onto the coated PET web 20. The particularly preferred ceramic fiber 25 is Textron SCS-6 silicon carbide fiber having an average diameter of approximately 140 microns (5.6 mils). The drum is rotated in the direction shown around the axle 17, forming a wound fiber or fiber mat 27 on the PET web 20 illustrated in FIG. 2. Succeeding fiber wraps in the mat are spaced apart axially by a distance of about 7–10 mils (180–250 microns), center-to-center, forming a helical pattern. The mat 27 is covered with a thin film of polyisobutylene 29, again applied dissolved in toluene, to stabilize the mat. The film is dried to remove toluene. The substrate 20 and attached mat 27 are then removed from the drum 15 by cutting through fiber and substrate on a line parallel to the axle 17.

Figure 3:
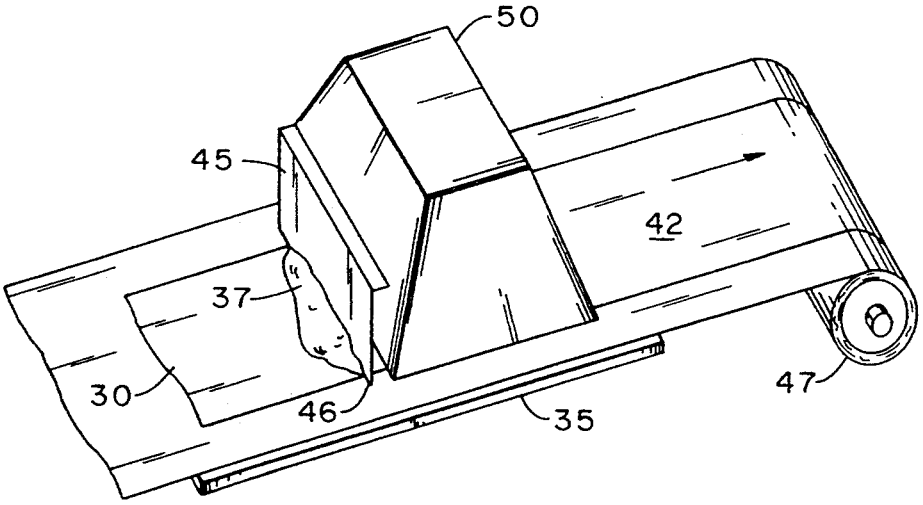
FIG. 3 is a fragmentary, perspective view of an apparatus for making a powder and binder tape in accordance with the present invention.

The matrix powder and binder coating are prepared as illustrated in FIG. 3. A PET web or substrate 30 is disposed against a flat bed 35 of a tape caster, beneath a doctor blade 45 having a lower edge 46 extending generally parallel to the top surface of the PET web. The PET web 30 is driven in the direction shown so as to pass at a constant rate beneath the doctor blade 45. A slurry 37 of titanium alloy powder and organic medium is supplied at the leading face of the doctor blade 45 and spread over the moving PET web 30. The slurry is made by dissolving 6.42 grams of solid polyisobutylene (average molecular weight 75,000) in 80 grams of toluene to form the organic medium and then adding 156.4 grams of Ti-6Al-4V powder having a top particle size of about 177 microns (80 mesh). The preferred coating or tape 42 has a wet thickness of approximately 20 mils (500 microns) which is controlled by adjusting the gap between the doctor blade 45 and the free surface of the PET web 30. The cast coating 42 is next passed through a drying hood 50 to remove the toluene. The PET web 30 with attached powder and binder coating 42 is collected on take-up roll 47.

We have achieved good results casting a tape 7.5 inches wide at a speed of 20 inches per minute. The same speed should be sustainable when the tape width is increased to 48 inches. At this rate, it should be possible to cast the tape at a rate of 400 square feet per hour, assuming continuous operation. This amounts to casting at a rate of over 40 pounds of titanium aluminide powder per hour which is very economical compared with induction plasma spray deposition (IPD) which has a much lower deposition rate.

We have found that cast titanium aluminide tapes can have acceptably low impurity contents when made in accordance with our invention. For example, the following results were achieved on monolithic (unreinforced) tapes cast from a Ti-6Al-4V titanium alloy powder and a Ti-10Al-26Nb titanium aluminide powder, both made with a polyisobutylene binder.

TABLE 1

| | Impurity Contents (ppm) | | | Strength Values | | |
|---|---|---|---|---|---|---|
| Alloy | O | N | C | UTS | E | Elongation |
| Ti-6Al-4V | 2000 | — | 350 | 144 ksi | 16.6 msi | 10% |
| Ti-10Al-26Nb | 1100 | 200 | 99 | 113 ksi | 14.2 msi | 5% |

The C contents of powders used as starting materials for the tapes described in Table 1 were as follows: Ti-6Al-4V, 150 ppm; and Ti-10Al-26Nb, 90 ppm. It can be seen from this data that the polyisobutylene binder added surprisingly little carbon to the cast tape made therefrom. Low contents of C, O and N impurities assure adequate ductility in composite structures made from the powder.

Figure 4:
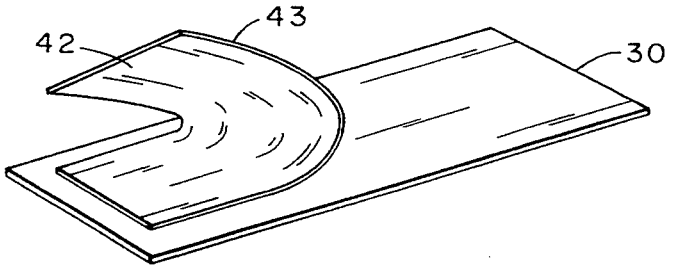
FIG. 4 is a perspective view showing the separation of a dried powder and binder tape from a PET web.
Figure 5:
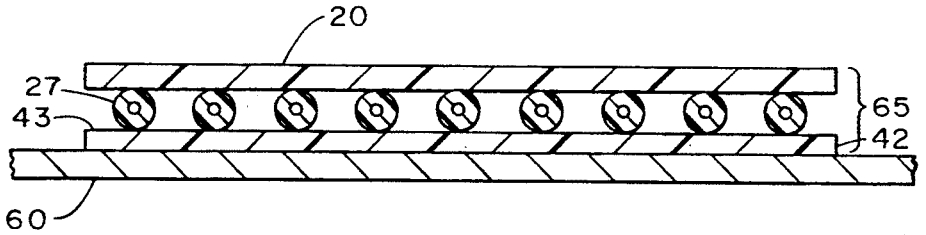
FIG. 5 is a cross-sectional view showing a method for making a fiber-reinforced tape in accordance with the invention.

Fiber mats are coated with powder and binder as illustrated in FIG. 4 and 5. A tape 42 comprising a dried powder and binder film is separated from a suitably-sized segment of PET substrate 30, as shown in FIG. 4. Referring now to FIG. 5, this tape 42 is placed on a flat substrate 60 with the surface 43 that had been attached to the PET substrate 30 facing upward. The fiber mat 27 attached to the PET web 20 is brought into contact with the tape 42 such that the polyisobutylene binder on the tape surface 43 adheres to the polyisobutylene binder coating the fiber mat 27. The fiber mat 27, PET web 20 and tape 42 are thereby combined into a coated mat with substrate all designated by the numeral 65 in FIG. 5.

Figure 6:
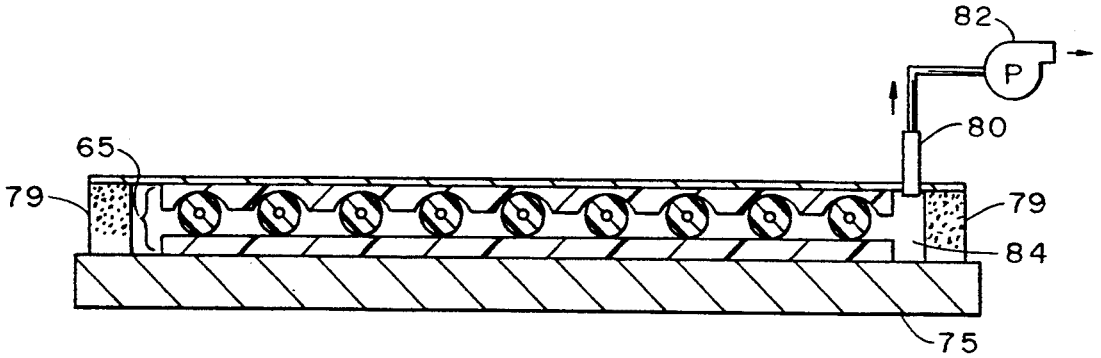
FIG. 6 is a schematic view of an apparatus for making an unconsolidated composite sheet material.

FIG. 6 illustrates how the tape and fiber mat of member 65 are brought into intimate contact. The member 65 is placed on a rigid, unitary flat sheet 75, commonly called a caul plate. A thin and flexible polymeric sheet 77 is attached at its edges to the caul plate 75 and sealed by convenient sealing means 79 so as to hermetically contain the member 65. A connecting tube 80 penetrates through the covering polymeric sheet 77 and is connected to a vacuum system 82. The space 84 between the caul plate 75 and the covering polymeric sheet 77 is evacuated through the tube 80. The pressure differential thus created between the cavity and the surrounding atmosphere causes the fiber mat 27 and attached powder and binder tape 42 of member 65 to come into intimate contact. The vacuum bagging process described above is repeated for all plies of the composite and also for the multi-ply composite sheet 86 of FIG. 7, resulting in a relatively strong and flexible unconsolidated composite sheet.

Figure 7:
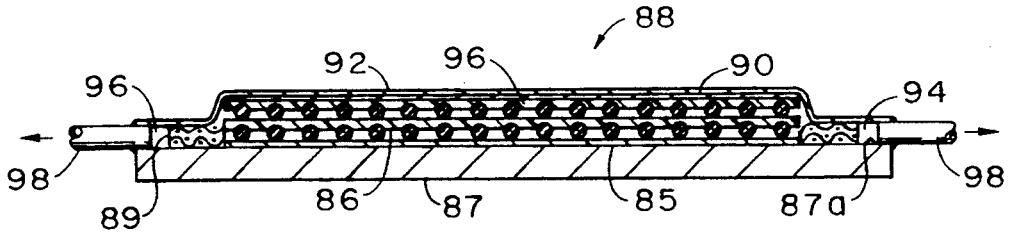
FIG. 7 is a schematic view of a steel tool for consolidating sheet material made in the apparatus of FIG. 6.

Small plan area ($<\sim 0.02$ square meters) unconsolidated sheets are encapsulated in a single-sided carbon steel tool 88 as illustrated in FIG. 7. Unconsolidated sheets of larger plan area (not shown) may be encapsulated in double-sided steel tools to minimize the effects of mismatch in coefficient of thermal expansion between the tool material and the consolidated sheet. If this effect is not anticipated consolidated parts and tools will distort unacceptably. Referring now to FIG. 7 for clarity, a first sheet of 2–5 mil (50–125 micron) molybdenum foil 85, which has been previously coated with a boron nitride release compound adjacent the upper side 87*a* of the bottom part 87 of the carbon steel tool 88, is placed on the part 87. The bottom part 87 of the carbon steel tool is at least 0.006 meters (6 mm) thick to minimize distortion. The unconsolidated multi-ply, composite sheet or stack 86 is placed on the coated molybdenum foil 85, confined laterally with a stainless steel screen 89, and covered with a second sheet of boron nitride-coated molybdenum foil 90. A thin ($\sim 5\times10^{-4}$ meters thick) carbon steel sheet 92 is placed on top of the coated molybdenum foil 90 and joined at its edges by fusion welding to the bottom tool part 87, except at openings 94 and 96 where tubes 98 are inserted and joined by fusion welding to both capsule parts to facilitate further processing. All welds must be hermetic.

It is critical to fabrication of a high quality composite sheet that the thin carbon steel sheet 92 be made to conform to the shape of the unconsolidated sheet 86 while the polyisobutylene binder is present. If that carbon steel sheet does not conform to the unconsolidated sheet 86, then the arrangement of powder and fiber will be disturbed by subsequent processing. The thin carbon steel sheet 92 is made to conform by temporarily sealing tubes 98 and processing the capsule with unconsolidated sheet 86 in a cold isostatic press or autoclave at room temperature and at about 500 pounds per square inch. The pressure differential between the outside and inside of the capsule causes the thin carbon steel sheet 92 to plastically deform and conform to the shape of the encapsulated, unconsolidated sheet 86.

Figure 8:
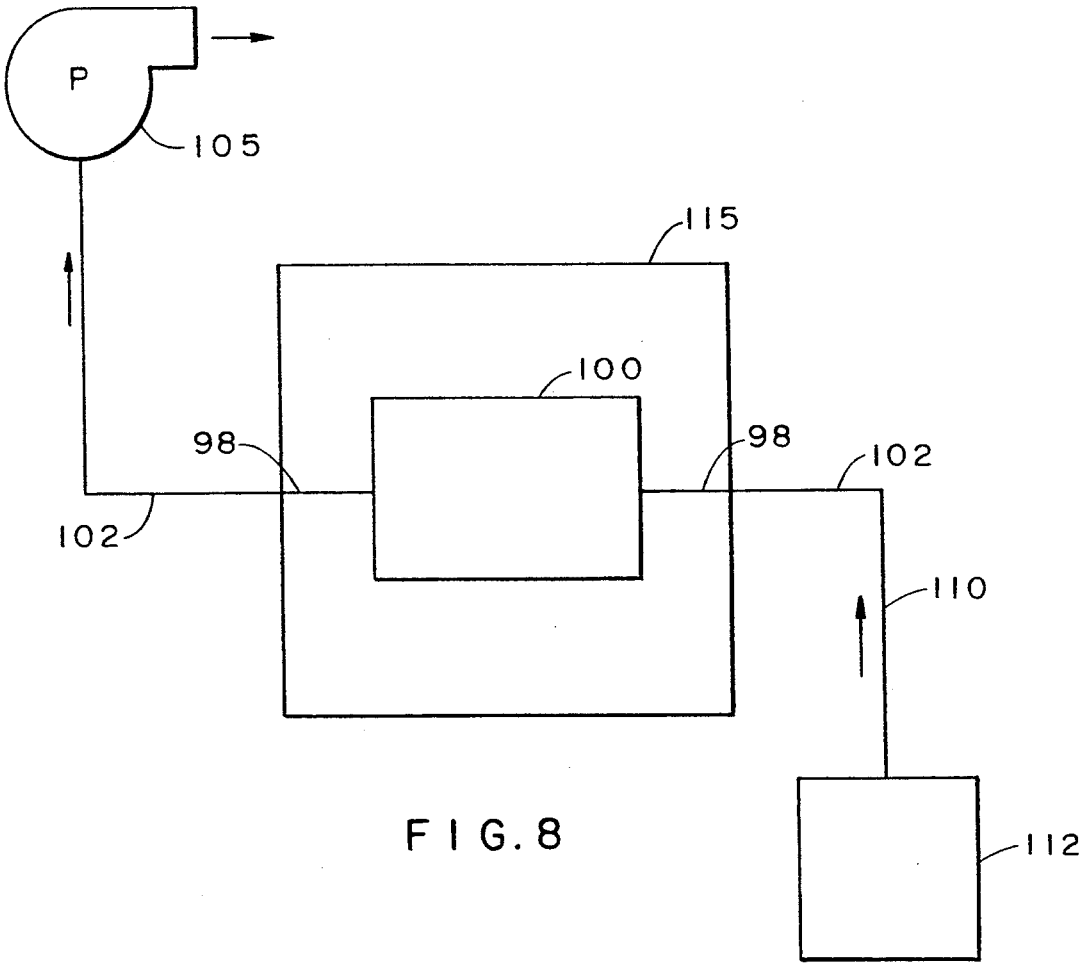
FIG. 8 is a schematic view of an apparatus for removing gases from unconsolidated sheet material.

FIG. 8 shows how the polyisobutylene binder and any adsorbed gases are removed before consolidation. The apparatus shown here is designed to operate with a sub-atmospheric internal pressure of about 200–400 millitorr to assist in binder and adsorbed gas removal and with a purge of purified noble gas to eliminate backstreaming of contaminants from the vacuum system. Suitable noble gases are argon, helium, neon and xenon. Argon is particularly preferred. Temperature of the system is greater than about 600° C. It is critical to the quality of the composite that the system be hermetic with regard to the surrounding atmosphere. The encapsulated, unconsolidated sheet 100 is inserted into the apparatus by connecting short tubes 98 to connecting tubes 102. Operating pressure is established by starting a vacuum pump 105 and adjusting noble gas flow through a gas inlet 110. When the noble gas purification system 112 is operating, the furnace 115 begins a slow temperature ramp to pyrolyze the polyisobutylene binder and facilitate removal of adsorbed gases. The small plan area sheets of FIG. 6 are heated at a rate of 30° C./hour up to 500° C. Subsequently, the furnace 115 ramps to about 900° C. at 600° C./hour to facilitate adsorbed gas removal and further deformation of the thin carbon steel capsule cover sheet 92. Upon cooling to room temperature, tubes 98 are sealed by fusion welding. Finally, the capsule 100 containing the unconsolidated arrangement of fiber and powder is removed from the apparatus and consolidated in a hot isostatic press at high temperature and pressure (927° C., 15 ksi, 2 hours for Ti-6Al-4V) resulting in a unitary, high temperature metal matrix composite sheet.

The foregoing description of our invention has been made with reference to a particularly preferred embodiment. Persons skilled in the art will understand that numerous changes and modifications may be made therein without departing from the spirit and scope of the following claims.

What is claimed is:

1. A process for making a fiber reinforced composite structure comprising:

(a) tape casting a monolayer tape comprising substantially continuous fibers, a polymeric binder, and solid particles of a high temperature metal or intermetallic matrix material selected from the group consisting of titanium alloys, titanium aluminides, nickel aluminides and molybdenum disilicide;

(b) stacking a plurality of tapes cast in step (a) to form an unconsolidated multilayer composite stack;

(c) removing said polymeric binder from said unconsolidated stack by heating said stack at an elevated temperature in a vacuum; and (d) pressing said unconsolidated stack at an elevated temperature, thereby to form a consolidated, fiber reinforced composite structure.

2. The process of claim 1 wherein said binder is selected from the group consisting of polycarbonates, polystyrenes, polyisobutylenes, acrylics and mixtures and copolymers thereof.

3. The process of claim 2 wherein said binder is polyisobutylene.

4. The process of claim 1 wherein said fibers comprise a ceramic selected from the group consisting of silicon carbide, carbon, silicon nitride, aluminum oxide, mullite and combinations thereof.

5. The process of claim 1 wherein said matrix material is a titanium aluminide or a high temperature titanium alloy.

6. The process of claim 5 wherein said titanium aluminide or titanium alloy comprises particles having a top size greater than about 50 microns.

7. The process of claim 1 wherein said tape casting process further comprises forming a slurry containing an organic solvent comprising an aliphatic or aromatic hydrocarbon together with said binder and said particles.

8. The process of claim 7 wherein said organic solvent is toluene.

9. The process of claim 1 wherein step (a) includes controlling thickness of said tape by means of a doctor blade.

10. The process of claim 1 wherein step (a) comprises:

(i) coating a substrate covering a generally cylindrical body with a polymeric binder dissolved in an organic solvent and drying to remove said organic solvent;

(ii) winding a substantially continuous ceramic fiber in a helical pattern onto said coated substrate to form wound fiber and coating said wound fiber with a polymeric binder dissolved in an organic solvent and drying to remove said organic solvent;

(iii) removing said substrate and said ceramic fiber from said cylindrical body;

(iv) tape casting a slurry comprising a polymeric binder, an organic solvent and solid particles of titanium alloy or titanium aluminide matrix material onto said ceramic fiber and drying to remove said organic solvent, thereby to form an unconsolidated, ceramic fiber reinforced sheet on said substrate;

(v) controlling said unconsolidated reinforced sheet to a predetermined thickness by means of a doctor blade spaced from said substrate and having an edge portion extending generally parallel thereto; and (vi) separating said unconsolidated reinforced sheet from said substrate.

11. The process of claim 1 wherein step (a) comprises:

(i) coating an elongated substrate with a polymeric binder dissolved in an organic solvent and drying to remove said organic solvent;

(ii) placing a plurality of substantially continuous ceramic fibers adjacent said coated substrate;

(iii) tape casting a slurry comprising a polymeric binder, an organic solvent and solid particles of titanium alloy or titanium aluminide matrix material onto said ceramic fiber and said substrate and drying to remove said organic solvent, thereby to form an unconsolidated, organic binder, solid particulate and substantially continuous ceramic fiber sheet on said substrate;

(iv) controlling said unconsolidated reinforced sheet to a predetermined thickness by means of a doctor blade spaced from said substrate and having an edge portion extending generally parallel thereto; and (v) separating said unconsolidated reinforced sheet from said substrate.

12. The process of claim 1 wherein step (b) comprises stacking a plurality of sheets made by step (a) to form an unconsolidated multilayer stack and then pressing said unconsolidated multilayer stack to increase its strength and stability.

13. The process of claim 1 wherein step (c) comprises:

(i) encapsulating said unconsolidated stack in a tool comprising a steel bottom pan and a steel top part spaced upwardly of said bottom part and having lesser thickness than said bottom part;

(ii) compressing said tool so that said top pan plastically deforms around said stack; and (iii) heating said stack in a vacuum while purging with a noble gas at an elevated temperature greater than about 600° C., thereby to pyrolyze and remove said polymeric binder.

14. The process of claim 1 wherein step (d) comprises hot isostatic pressing said unconsolidated stack, thereby to form a consolidated, fiber reinforced structure.

15. The process of claim 1 wherein step (d) comprises hot pressing said unconsolidated stack, thereby to form a consolidated, fiber reinforced structure.

16. The process of claim 1 wherein step (d) comprises vacuum hot pressing said unconsolidated stack, thereby to form a consolidated, fiber reinforced structure.

17. The process of claim 13 wherein said noble gas comprises argon.

18. The processs of claim 13 wherein said noble gas comprises helium.

19. A process for making a composite structure comprising a titanium aluminide matrix reinforced with silicon carbide fibers comprising:

(a) tape casting a tape comprising solid titanium aluminide particles, substantially continuous silicon carbide fibers, and a polymeric binder selected from the group consisting of polycarbonates, polystyrenes, polyisobutylenes, acrylics and mixtures and copolymers thereof, said fibers comprising about 25–45 vol. % of the tape, (b) stacking a plurality of tapes cast by the process of step (a) to form an unconsolidated composite stack, (c) heating said stack at an elevated temperature in a vacuum, thereby to remove said polymeric binder from said stack, and (d) pressing said stack at an elevated temperature, thereby to form a composite structure comprising a titanium aluminide matrix reinforced with silicon carbide fibers.

20. The process of claim 19 wherein said binder is polyisobutylene.

* * * * *

UNITED STATES PATENT AND TRADEMARK OFFICE

CERTIFICATE OF CORRECTION

PATENT NO. : 5,405,571

DATED : April 11, 1995

INVENTOR(S) : William G. Truckner et al

It is certified that error appears in the above-indentified patent and that said Letters Patent is hereby corrected as shown below:

| | |
|---|---|
| Col. 6, lines 38-39 (Claim 6) | After "having", delete "a top size greater than about 50" and substitute therefor --an average particle size in the range of approximately 80-120-- |
| Col. 8, line 1 (Claim 12) | After "top", delete "pan" and substitute therefor --part-- |

Signed and Sealed this

Nineteenth Day of September, 1995

*Attest:*

Bruce Lehman

BRUCE LEHMAN

*Attesting Officer*

*Commissioner of Patents and Trademarks*